US011052438B2

(12) United States Patent
Gupta et al.

(10) Patent No.: US 11,052,438 B2
(45) Date of Patent: Jul. 6, 2021

(54) AUTOMATED WASHING OR RINSING APPARATUS FOR PACKAGES, CONTAINERS, AND ASSOCIATED LIDS

(71) Applicant: Ecolab USA Inc., St. Paul, MN (US)

(72) Inventors: Amit Gupta, Aurora, IL (US); Brian Pawlik, Elmhurst, IL (US)

(73) Assignee: ECOLAB USA INC., St. Paul, MN (US)

( * ) Notice: Subject to any disclaimer, the term of this patent is extended or adjusted under 35 U.S.C. 154(b) by 202 days.

(21) Appl. No.: 16/029,123

(22) Filed: Jul. 6, 2018

(65) Prior Publication Data

US 2019/0009312 A1 Jan. 10, 2019

Related U.S. Application Data

(60) Provisional application No. 62/530,364, filed on Jul. 10, 2017.

(51) Int. Cl.

| | |
|---|---|
| ***B08B 9/093*** | (2006.01) |
| ***B08B 9/34*** | (2006.01) |
| *B08B 3/14* | (2006.01) |

(52) U.S. Cl.

CPC ..... *B08B 9/093* (2013.01); *B08B 9/34* (2013.01); *B08B 3/14* (2013.01); *B08B 2209/085* (2013.01)

(58) Field of Classification Search

CPC ..... B08B 9/093

See application file for complete search history.

(56) References Cited

U.S. PATENT DOCUMENTS

| | | | | |
|---|---|---|---|---|
| 3,916,924 | A | 11/1975 | McGowen | |
| 4,142,545 | A | 3/1979 | Billigmeier | |
| 4,344,469 | A | 8/1982 | Brown | |
| 4,702,267 | A | 10/1987 | Ashraff | |
| 4,905,871 | A | 3/1990 | Dutertre | |
| 5,033,492 | A | 7/1991 | Mertens et al. | |
| 5,117,857 | A | 6/1992 | Smith | |
| 5,186,195 | A | 2/1993 | Wall | |
| 5,996,600 | A | 12/1999 | Ostry | |
| 2009/0165862 | A1* | 7/2009 | Johansson | A61L 2/22 137/13 |
| 2013/0146107 | A1 | 6/2013 | Castro | |

OTHER PUBLICATIONS

Braun, H.E., D.C. Morrow, B.D. Ripley, and R. Frank. "Efficiency of Water Rinsing for the Decontamination of Used Pesticide Containers," Archives of Environmental Contamination and Toxicology, 12(3), 257-263 (1983).

Noyes, Ronald T., P.E. Norris, and J.T. Criswell. "Rinsing and Disposing of Pesticide Containers," Oklahoma Cooperative Extension Service, Division of Agricultural Sciences and Natural Resources, Oklahoma State University: 7462-1-7462-4 (1991).

* cited by examiner

*Primary Examiner* — Jason Y Ko

(74) *Attorney, Agent, or Firm* — Eric D. Babych; Barnes & Thornburg LLP

(57) ABSTRACT

The present disclosure generally relates to washing or rinsing of packages, containers, and associated lids. More particularly, the disclosure pertains to a washing or rinsing apparatus for cleaning packaging for biocides. A rinsing apparatus is that includes a housing, which has a wash section and a drain section. The rinsing apparatus includes a stop plate disposed within the housing that divides the wash section from the drain section. The apparatus includes a solution distribution nozzle disposed within the wash section of the housing.

6 Claims, 6 Drawing Sheets

AUTOMATED WASHING OR RINSING APPARATUS FOR PACKAGES, CONTAINERS, AND ASSOCIATED LIDS

BACKGROUND

1. Field of the Invention

The present disclosure generally relates to washing or rinsing of packages, containers, and associated lids. More particularly, the disclosure pertains to a washing or rinsing apparatus for cleaning packaging for biocides.

2. Description of the Related Art

Containers for oxidizing and non-oxidizing biocides need to be properly washed before disposal. The containers may contain residual biocide or other chemicals that could be hazardous to the environment or to personnel tasked with disposing of the containers.

BRIEF SUMMARY

In some embodiments, a rinsing apparatus is disclosed that may include a housing having a wash section and a drain section. The rinsing apparatus may include a stop plate disposed within the housing, wherein the stop plate divides the wash section from the drain section. The stop plate may include at least one perforation. The rinsing apparatus may include a solution distribution nozzle disposed within the wash section of the housing and a solution line in fluid communication with the solution distribution nozzle and a solution source. The rinsing apparatus may include a valve on the solution line to control flow of a rinsing solution to the solution distribution nozzle.

In some embodiments, the rinsing apparatus may include a lid washing compartment positioned within the drain section of the housing and below the stop plate.

In some embodiments, the lid washing compartment may have a plurality of perforations.

In some embodiments, the housing may include a hatch through which the lid washing compartment may be removed or a lid may be inserted.

In other embodiments, the lid washing compartment may be positioned adjacent to the housing.

In some embodiments, the solution line may be connected to the lid washing compartment and may carry the rinsing solution to the lid washing compartment.

In some embodiments, an actuation device may be in electrical or mechanical communication with the valve for controlling flow of the rinsing solution.

In some embodiments, the stop plate may include a plurality of perforations.

In some embodiments, the drain section may include a drain.

In some embodiments, a method is disclosed. The method may include placing a container or package in a housing of a rinsing apparatus. The rinsing apparatus may include a stop plate disposed within the housing, wherein the stop plate divides a wash section from a drain section and comprises at least one perforation. The rinsing apparatus may include a solution distribution nozzle disposed within the wash section of the housing and a solution line in fluid communication with the solution distribution nozzle and a solution source. The rinsing apparatus may include a valve on the solution line to control flow of a rinsing solution to the solution distribution nozzle, wherein the solution distribution nozzle is positioned such that the rinsing solution can contact the inside of the container or package. The method may include rinsing the container or package by opening the valve to allow the rinsing solution to flow through the solution line to the solution distribution nozzle. The method may include allowing the rinsing solution to pass through at least one perforation in the stop plate into the drain section of the housing. The method may include draining the rinsing solution through a drain in the drain section of the housing.

In some embodiments, the method may include rinsing a lid that is placed in a lid washing compartment using the rinsing solution that passes through the stop plate, wherein the lid washing compartment is positioned within the drain section of the housing and below the stop plate.

In some embodiments, the lid washing compartment may include a plurality of perforations.

In some embodiments, the method may include sensing the container or package using an actuation device that is in electrical or mechanical communication with the valve for controlling flow of the rinsing solution.

In some embodiments, the method may include recycling drained rinsing solution to an antimicrobial feeder apparatus or back to the solution distribution nozzle.

In some embodiments, the container or package may include residual antimicrobial.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE SEVERAL VIEWS OF THE DRAWINGS

A detailed description of the invention is hereafter described with specific reference being made to the drawings in which.

DETAILED DESCRIPTION

Figure 1:
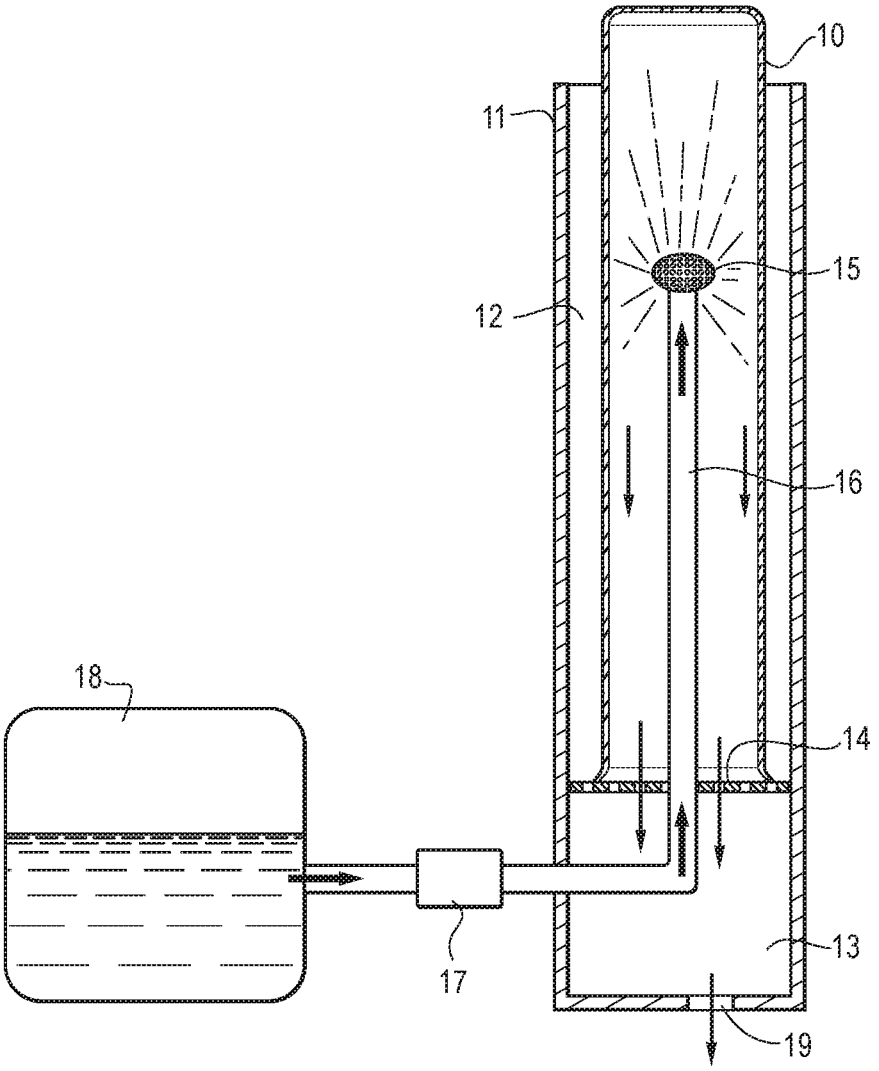
FIG. 1 shows a schematic cross-section of an embodiment of a rinsing apparatus.

Various embodiments are described below with reference to the drawings in which like elements generally are referred to by like numerals. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments disclosed herein, such as—for example—conventional fabrication and assembly.

Empty containers used to store oxidizing or non-oxidizing antimicrobial agents may contain residual antimicrobials or other chemicals that could be hazardous to the environment or to personnel tasked with disposing of or cleaning the containers. In addition, many containers have removable lids that are also contaminated with residual chemical. The present disclosure describes rinsing devices and rinsing methods that can rinse containers and lids in an automated fashion. Using the disclosed devices and methods minimizes personnel's exposure to harmful chemicals, while also complying with United States regulations dictating rinsing the container prior to disposal.

In some embodiments, a rinsing apparatus is disclosed. The rinsing apparatus may include a housing, which may have a wash section and a drain section. The rinsing apparatus may have a stop plate disposed within the housing, and may divide the wash section from the drain section and may include at least one perforation. The stop plate may be connected to an inner wall of the housing. The apparatus may include a solution distribution nozzle disposed within the wash section of the housing. The apparatus may include a solution line in fluid communication with the solution distribution nozzle and a solution source. The apparatus may also include a valve on the solution line to control flow of a rinsing solution to the solution distribution nozzle. As used herein, "nozzle" refers to any device that can distribute solution.

In other embodiments, the rinsing apparatus may include a lid washing compartment positioned within the drain section of the housing and below the stop plate. The lid washing compartment may include a plurality of perforations. The lid washing compartment may be removed from the housing or a lid may be inserted through a hatch or opening in a wall of the housing.

In some embodiments, the rinsing apparatus may include a lid washing compartment positioned adjacent to the housing. The lid compartment may be outside the walls of the housing. In some embodiments, the water solution line may be connected to the lid washing compartment and carry rinsing solution to the lid washing compartment.

In some embodiments, the rinsing apparatus may include an actuation device in electrical or mechanical communication with the valve for controlling flow of the rinsing solution.

In some embodiments, the stop plate may include a plurality of perforations.

In some embodiments, the drain section may include a drain. In some embodiments, the drain may be in fluid communication with a pump that can recycle the wash solution. The rinsing solution may be recycled by pumping fluid from the drain back to the solution line or to the solution source.

In some embodiments, a method is disclosed for washing containers or packages that may include placing the container or package in a housing of a rinsing apparatus. The rinsing apparatus may have a stop plate disposed within the housing and connected to an inner wall of the housing. The stop plate may divide the wash section from the drain section in the housing. The stop plate may include at least one perforation. The rinsing apparatus may include a solution distribution nozzle disposed within the wash section of the housing and a solution line in fluid communication with the solution distribution nozzle and a solution source. A valve may be placed on the solution line to control flow of a rinsing solution to the solution distribution nozzle. The solution distribution nozzle may be positioned such that the rinsing solution can contact the inside of the container or package. The method may include rinsing the container or package by opening the valve to allow the rinsing solution to flow through the solution line to the solution distribution nozzle. The method also includes allowing the rinsing solution to pass through the at least one perforation in the stop plate into the drain section of the housing and draining the rinsing solution through a drain in the drain section of the housing.

In some embodiments, the rinsing solution is water. The rinsing solution may be supplemented with additional additives to aid in cleaning the containers. Suitable additives include surfactants, solvents, or neutralizing agents. One of skill in the art may be able to determine a suitable cleaning solution for the containers. It is envisioned that many different kinds of cleaning solutions can be used in connection with the disclosed methods.

In some embodiments, the method may include rinsing a lid that is placed in a lid washing compartment using the rinsing solution that passes through the stop plate. The lid washing compartment may be positioned within the drain section of the housing and below the stop plate.

In some embodiments, the lid washing compartment may include a plurality of perforations.

In some embodiments, the housing may include a hatch through which the lid washing compartment may be removed or a lid may be inserted. As used herein "hatch" refers to an opening in the housing.

In some embodiments, the method may include sensing the container or package using an actuation device that is in electrical or mechanical communication with the valve for controlling flow of the rinsing solution. The sensing device may be connected to or in electrical or mechanical communication with the stop plate. When a container is placed on the stop plate the sensing device can send a signal to the valve to allow flow of the rinsing solution. When the container is removed the sensing device may signal to the valve to close, thereby stopping the flow of rinsing solution. In some embodiments, the sensing device may be in communication with a programmed logic controller (PLC). The PLC may be programmed to open the valve for a predetermined amount of time when the sensing device signals to the PLC that a container is placed on the stop plate.

In some embodiments, the method may include recycling the drained rinsing solution to an antimicrobial feeder apparatus.

In some embodiments, the container or package to be rinsed or washed may include residual antimicrobial.

Referring to the Figures, FIG. 1 shows an embodiment of a rinsing apparatus. A container 10 can be inserted into the housing 11, which may include a wash section 12 and a drain section 13 divided by a stop plate 14. A solution distribution nozzle 15 can be disposed within the housing 11 in the wash section 12. The solution distribution nozzle 15 can be positioned in the housing such that the inside of the container 10 can be washed. The flow of rinsing solution through the solution line 16 may be controlled using a valve 17. A rinsing solution source 18 may provide solution to the rinsing apparatus. The rinsing apparatus may include a drain 19.

Figure 2:
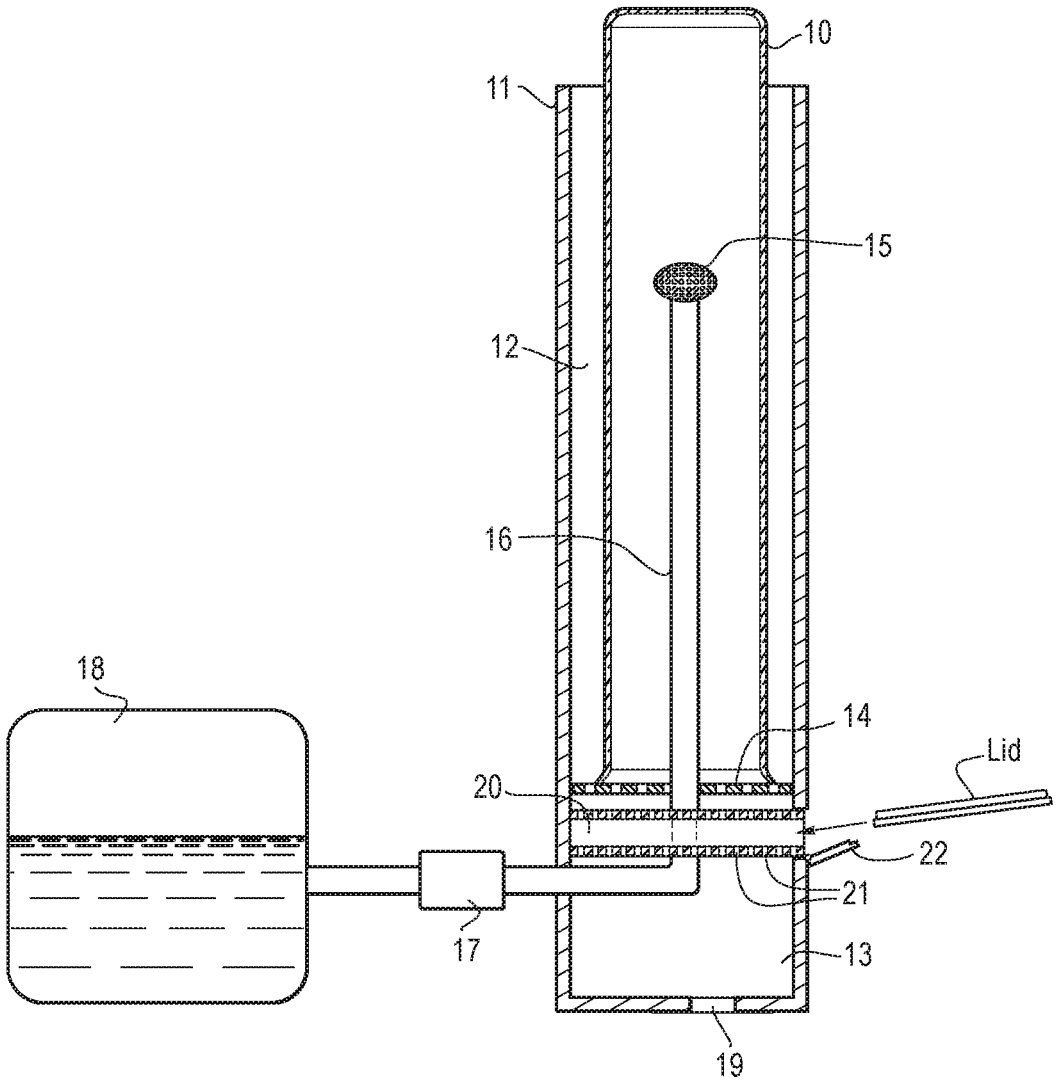
FIG. 2 shows a schematic cross-section of an embodiment of a rinsing apparatus.

FIG. 2 shows an embodiment of a rinsing apparatus that includes a lid washing compartment 20. The lid washing compartment 20 may include a plurality of perforations 21.

The rinsing apparatus may also include a hatch 22 through which the lid washing compartment 20 can be removed or a lid can be inserted.

Figure 3:
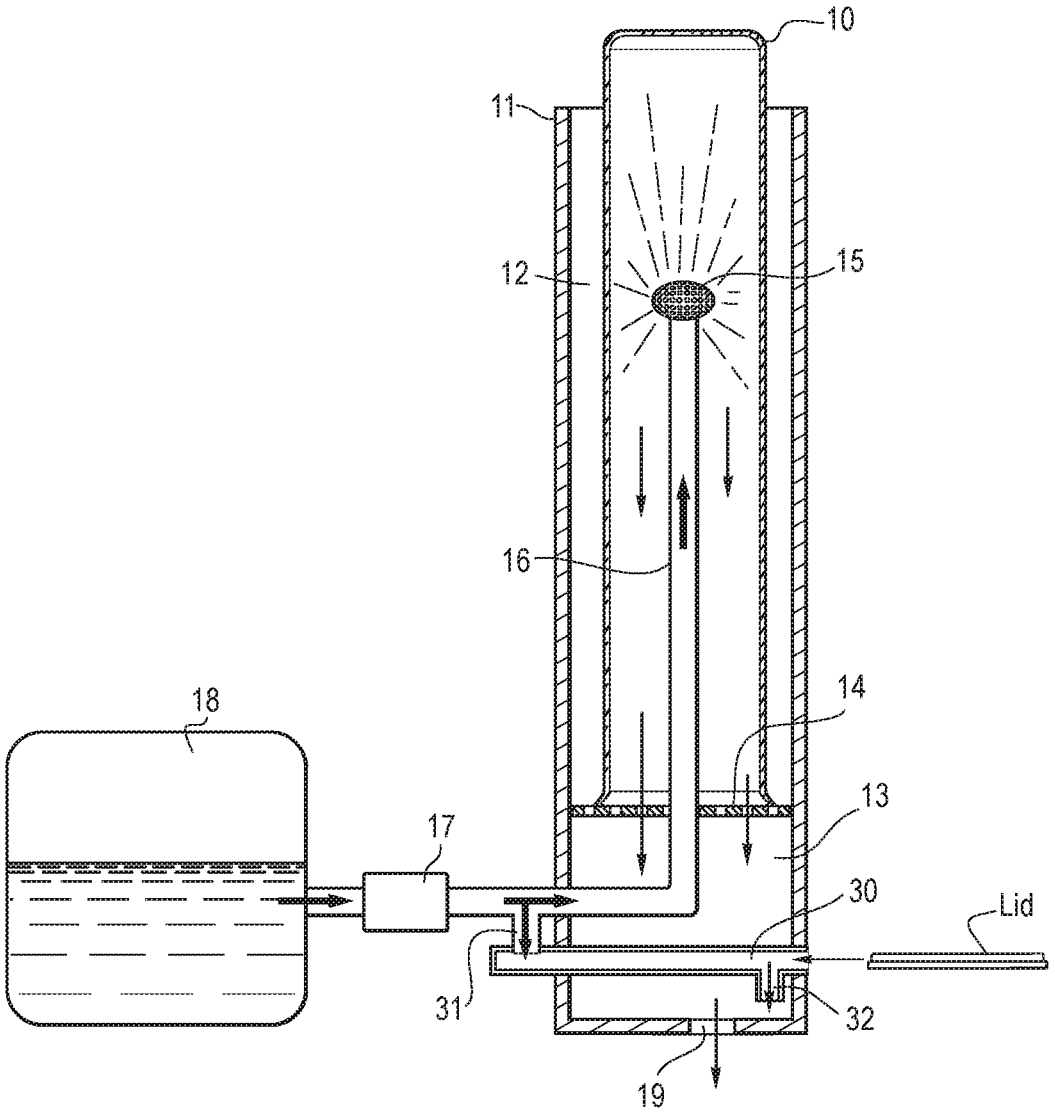
FIG. 3 shows a schematic cross-section of an embodiment of a rinsing apparatus.

FIG. 3 shows an embodiment of a rinsing apparatus where a lid washing compartment 30 may receive a rinsing solution through a lid washing feed line 31. The valve 17 may control flow of the rinsing solution through solution line 16 and the lid washing feed line 31. After the rinsing solution washes the lid in the lid washing compartment 30, the solution may exit through a lid drain line 32.

Figure 4:
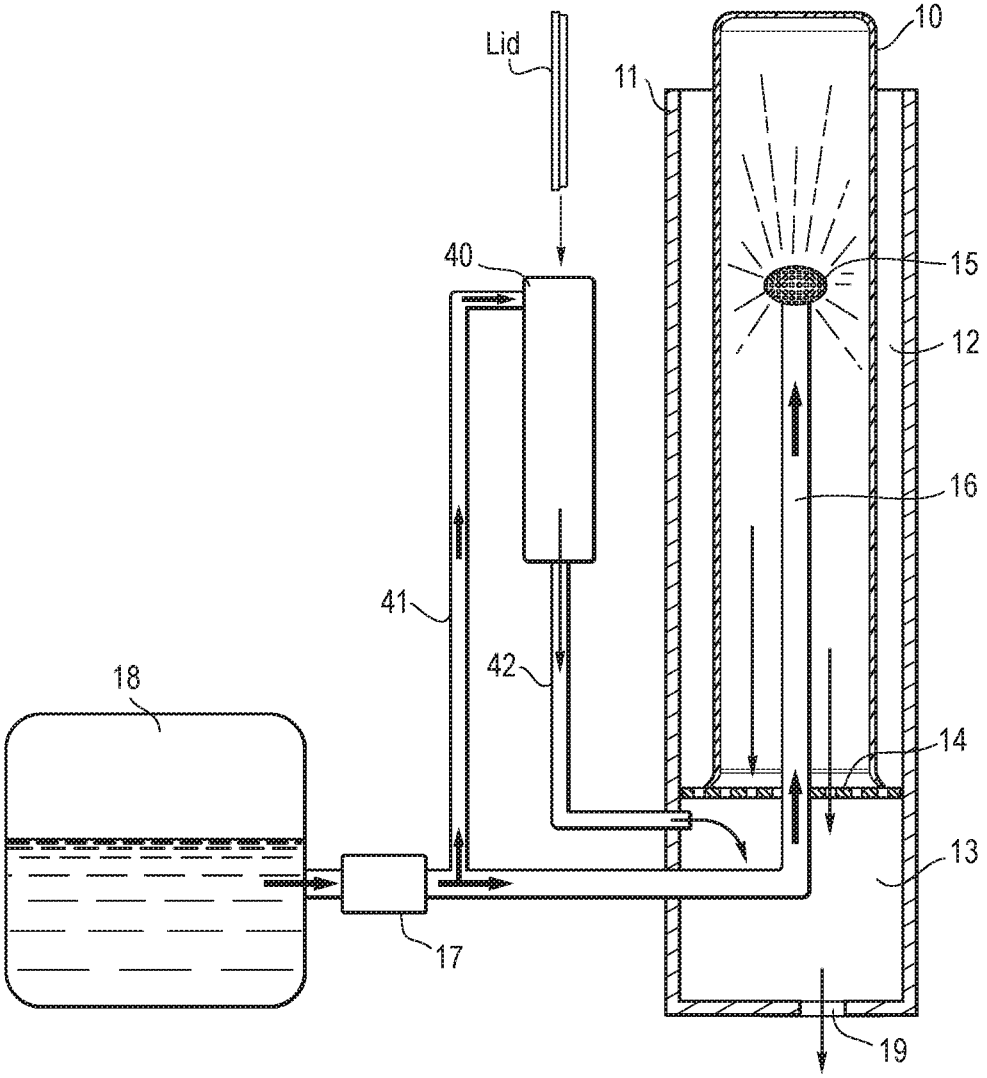
FIG. 4 shows a schematic cross-section of an embodiment of a rinsing apparatus.

FIG. 4 shows an embodiment of a rinsing apparatus where a lid washing compartment 40 may be positioned outside the housing 11. A lid washing feed line 41 may carry rinsing solution to the lid washing compartment 40. After the rinsing solution washes the lid in the lid washing compartment 40, the solution may exit through the lid drain line 42 into the drain section 13.

Figure 5:
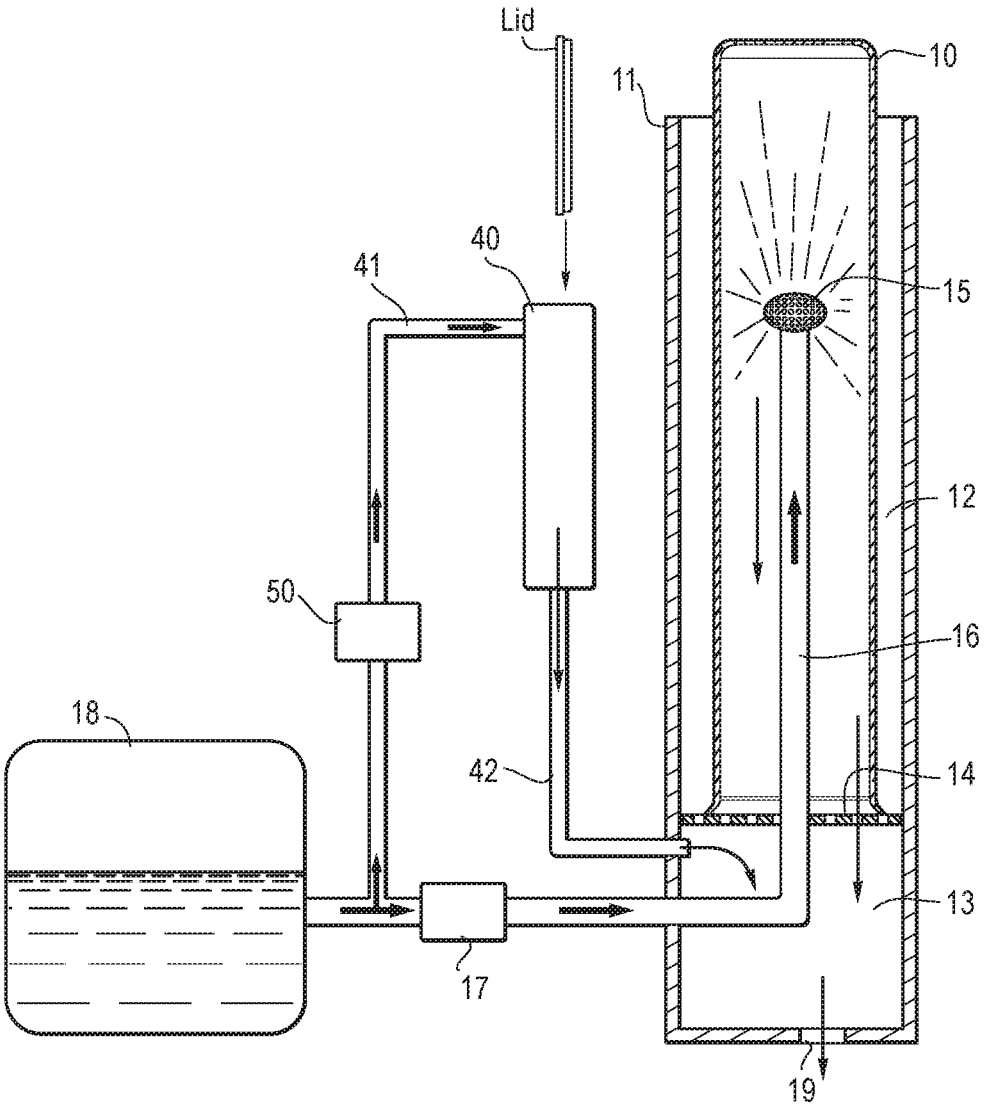
FIG. 5 shows a schematic cross-section of an embodiment of a rinsing apparatus.

FIG. 5 shows an embodiment of a rinsing apparatus where a lid washing compartment 40 may be positioned outside the housing 11. A lid washing feed line 41 may carry rinsing solution to the lid washing compartment 40. Flow of rinsing solution through the lid washing feed line 41 may be controlled using a valve 50. In this embodiment, the lid can be washed independently of the container 10.

In some embodiments, the rinsing solution used to rinse the lid may be different than the rinsing solution used to rinse the container 10.

Figure 6:
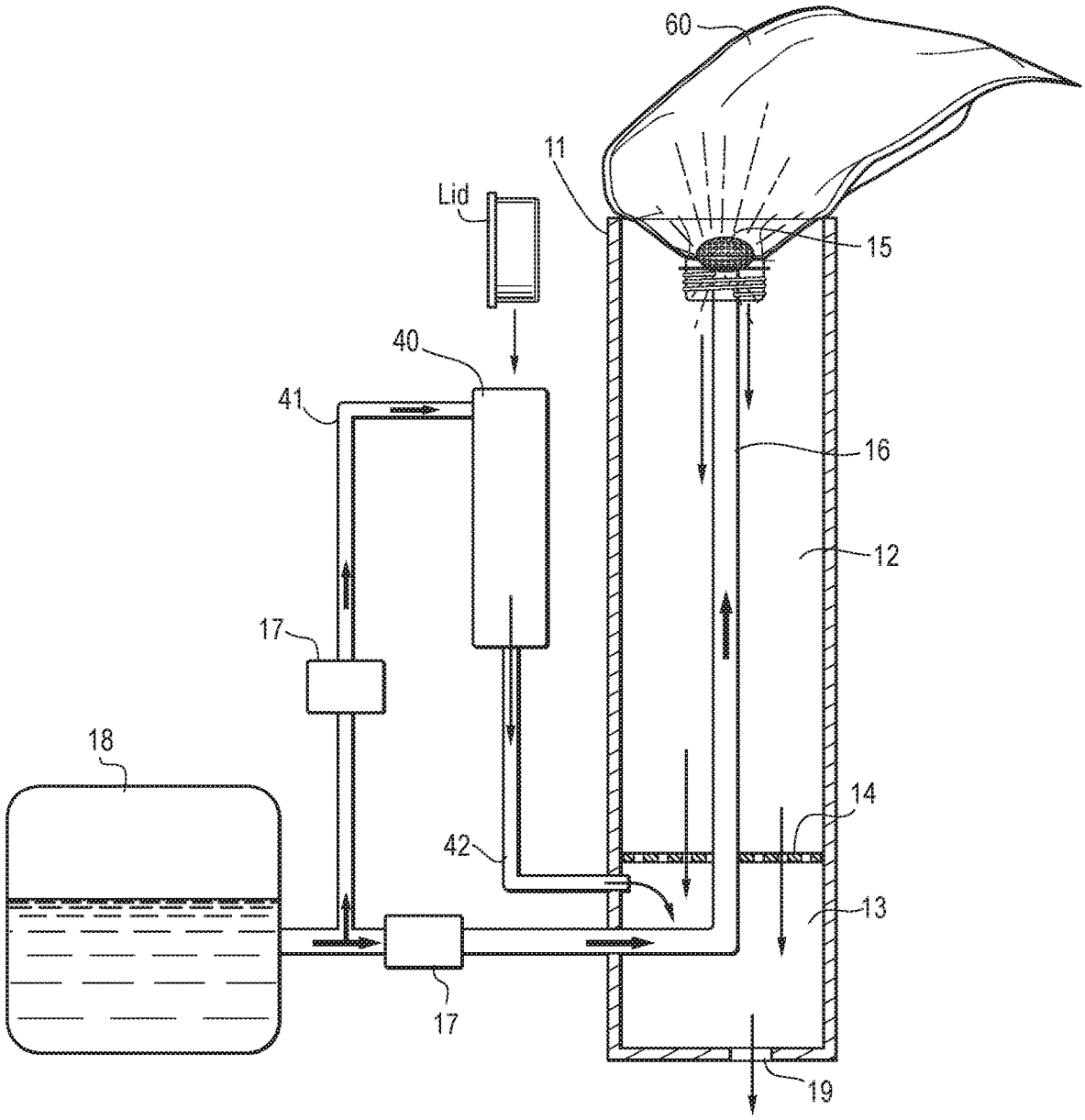
FIG. 6 shows a schematic cross-section of an embodiment of a rinsing apparatus.

FIG. 6 shows an embodiment of a rinsing apparatus that can rinse a non-rigid container 60. The solution distribution nozzle 15 may be extendable so that different sizes and shapes of containers can be sufficiently washed.

All of the devices and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a device" is intended to include "at least one device" or "one or more devices."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A rinsing apparatus, comprising:

a housing having a wash section and a drain section;

a stop plate disposed within the housing, wherein the stop plate divides the wash section from the drain section and comprises at least one perforation;

a solution distribution nozzle disposed within the wash section of the housing;

a solution line in fluid communication with the solution distribution nozzle and a solution source; and a valve on the solution line to control flow of a rinsing solution to the solution distribution nozzle, and wherein the valve is outside the housing and the solution source.

2. The rinsing apparatus of claim 1, further comprising a lid washing compartment positioned adjacent to the housing.

3. The rinsing apparatus of claim 1, further comprising an actuation device in electrical or mechanical communication with the valve for controlling flow of the rinsing solution.

4. The rinsing apparatus of claim 1, wherein the stop plate comprises a plurality of perforations, and wherein the rinsing solution enters the wash section only through the solution line in fluid communication with both the solution distribution nozzle and the solution source.

5. The rinsing apparatus of claim 1, the rinsing solution flows in a direction opposing gravity when it enters the wash section through the solution line in fluid communication with the solution distribution nozzle.

6. The rinsing apparatus of claim 1, wherein the solution distribution nozzle is separate from the solution source.

* * * * *